US011079191B1

(12) United States Patent
Sugg

(10) Patent No.: US 11,079,191 B1
(45) Date of Patent: Aug. 3, 2021

(54) FURTHER IMPROVEMENTS-FIREARMS AND WEAPONS SYSTEMS

(71) Applicant: Edward Sugg, South Riding, VA (US)

(72) Inventor: Edward Sugg, South Riding, VA (US)

( * ) Notice: Subject to any disclaimer, the term of this patent is extended or adjusted under 35 U.S.C. 154(b) by 0 days.

(21) Appl. No.: 15/932,484

(22) Filed: Mar. 6, 2018

Related U.S. Application Data

(63) Continuation-in-part of application No. 15/732,671, filed on Dec. 12, 2017, now Pat. No. 10,571,213.

(60) Provisional application No. 62/619,871, filed on Jan. 21, 2018, provisional application No. 62/530,297, filed on Jul. 10, 2017.

(51) Int. Cl.
*F41A 5/24* (2006.01)
*F41A 3/26* (2006.01)

(52) U.S. Cl.
CPC . *F41A 5/24* (2013.01); *F41A 3/26* (2013.01)

(58) Field of Classification Search
CPC ..... F41A 3/26; F41A 5/24
USPC ..... D22/108
See application file for complete search history.

(56) References Cited

U.S. PATENT DOCUMENTS 7,316,091 B1 * 1/2008 Desomma ..... F41A 3/26 42/16
7,461,581 B2 * 12/2008 Leitner-Wise ..... F41A 5/18 89/191.01
7,779,743 B2 * 8/2010 Herring ..... F41A 5/18 89/193
8,375,616 B2 * 2/2013 Gomez ..... F41A 3/26 42/16
8,991,295 B2 * 3/2015 Larue ..... F41A 5/24 89/193
9,803,941 B2 * 10/2017 LaRue ..... F41A 5/28

OTHER PUBLICATIONS

"DS Arms KEYLOC Improved Gas Key", https://www.tactical-life.com/firearms/ds-arms-keyloc-improved-gas-key (Year: 2012).*

* cited by examiner

*Primary Examiner* — Joshua T Semick
(74) *Attorney, Agent, or Firm* — Arent Fox LLP

(57) ABSTRACT

A detachable Gas Key, which attaches to a Bolt Carrier, which provides gas to power the action of a semi automatic or select fire firearm. Improvements are made in both the attachment strength, as well as a significantly improved seal between the Gas Key and the Bolt Carrier.

16 Claims, 8 Drawing Sheets

FURTHER IMPROVEMENTS-FIREARMS AND WEAPONS SYSTEMS

CROSS REFERENCE TO RELATED APPLICATIONS

This application claims priority to U.S. Provisional Patent Application No. 62/619,871, which was filed on Jan. 18, 2018, U.S. Provisional Patent Application No. 62/573,855, which was filed on Oct. 18, 2017, U.S. Provisional Patent Application No. 62/530,297, which was filed on Jul. 10, 2017, U.S. Provisional Patent Application 62/472,574, which was filed on Mar. 22, 2017, U.S. Provisional Patent Application 62/467,812, which was filed on Mar. 6, 2017, U.S. Provisional Patent Application No. 62/411,538, which was filed Oct. 22, 2016, U.S. Provisional Patent Application No. 62/405,195, which was filed Oct. 6, 2016, U.S. patent application Ser. No. 15/732,671 which was filed on Dec. 12, 2017, U.S. patent application Ser. No. 15/732,225, which was filed on Oct. 6, 2017, U.S. patent application Ser. No. 15/678,831, which was filed on Aug. 16, 2017, and U.S. patent application Ser. No. 15/248,525, which was filed on Aug. 15, 2016, the contents of each of which are incorporated herein by reference in their entirety.

TECHNICAL FIELD

This application addresses several new inventions and improvements to firearms in general, without limitation, and to the Stoner pattern family of weapons ("FOW") in particular. Aspects of the present invention relate to automatic and semi-automatic firearms, such as M-4 or AR-15 firearms, and more particularly to mechanical enhancements to improve faster reload, smoother firing, a reduced failure rate, and easier operation, for example.

BACKGROUND

The basic mechanical structure of AR-15, M-16, HK 416, HK 417, HK MR556, FN SCAR, and SIG S16, among other similar firearms, is known in the art. FIG. 1 shows an exploded view of a standard AR-15, which serves as an example of a firearm to which the inventive improvements disclosed herein may be applied. As shown in FIG. 1, the AR-15 firearm 10 includes, among other elements, a butt-stock 12, a lower receiver 14, a handle 16, a magazine well 18, a magazine 20, a trigger 22, a barrel 24, a bolt carrier 26, a bolt 28, a firing pin 30, a charging handle 32, an upper receiver 34, a gas tube 36, a gas key 48, a bolt catch 38, a sight 40, gas rings 42, a magazine catch 44, and a magazine release button 46. Standard operation of a standard AR-15 firearm is well known in the art.

FIG. 2 is a cross-sectional view of a gas key used in the Stoner pattern FOW. The gas key 48 includes a gas tube receiver 83, a gas tube receiver opening 72, and a gas passage 73. A flat surface 76 of gas key 48 is mounted to a corresponding flat surface (not shown) of bolt carrier 26 (FIG. 1) so that gas passage 73 is in fluid communication with a gas receiving opening, which may hereinafter be interchangeably referred to as a gas hole (not shown in FIGS. 1 and 2) In the bolt carrier 26 (FIG. 1). The gas key 48 is mounted to the bolt carrier via first and second through-holes 15*a* and 15*b* for receiving a threaded bolt that is engaged with corresponding threaded holes on the bolt carrier 26.

There remains a need in the art for firearms of the direct impingement and piston type that allow for faster reload, faster firing rate, improved servicing, a reduced failure rate, and easier operation, as compared to current semi-automatic or automatic type firearms.

SUMMARY

Aspects of the present disclosure relate to an improved detachable gas key for a bolt carrier, which may be removable for ease of service. The detachable gas key may include more than one screw or bolt for attachment, for example, and a sealing interface for sealing of the gas key and the carrier. The gas key may further include an anchor or other securing mechanism joining the bolt carrier and the gas key.

Additional advantages and novel features of these aspects will be set forth in part in the description that follows, and in part will become more apparent to those skilled in the art upon examination of the following or upon learning by practice of the disclosure.

BRIEF DESCRIPTION OF THE DRAWINGS

The accompanying drawings, which are incorporated into and constitute a part of this specification, illustrate one or more example aspects of the present disclosure and, together with the detailed description, serve to explain their principles and implementations.

FIG. 41*s* a side perspective view of the example gas key of FIG. 3.

DETAILED DESCRIPTION

Figure 1:
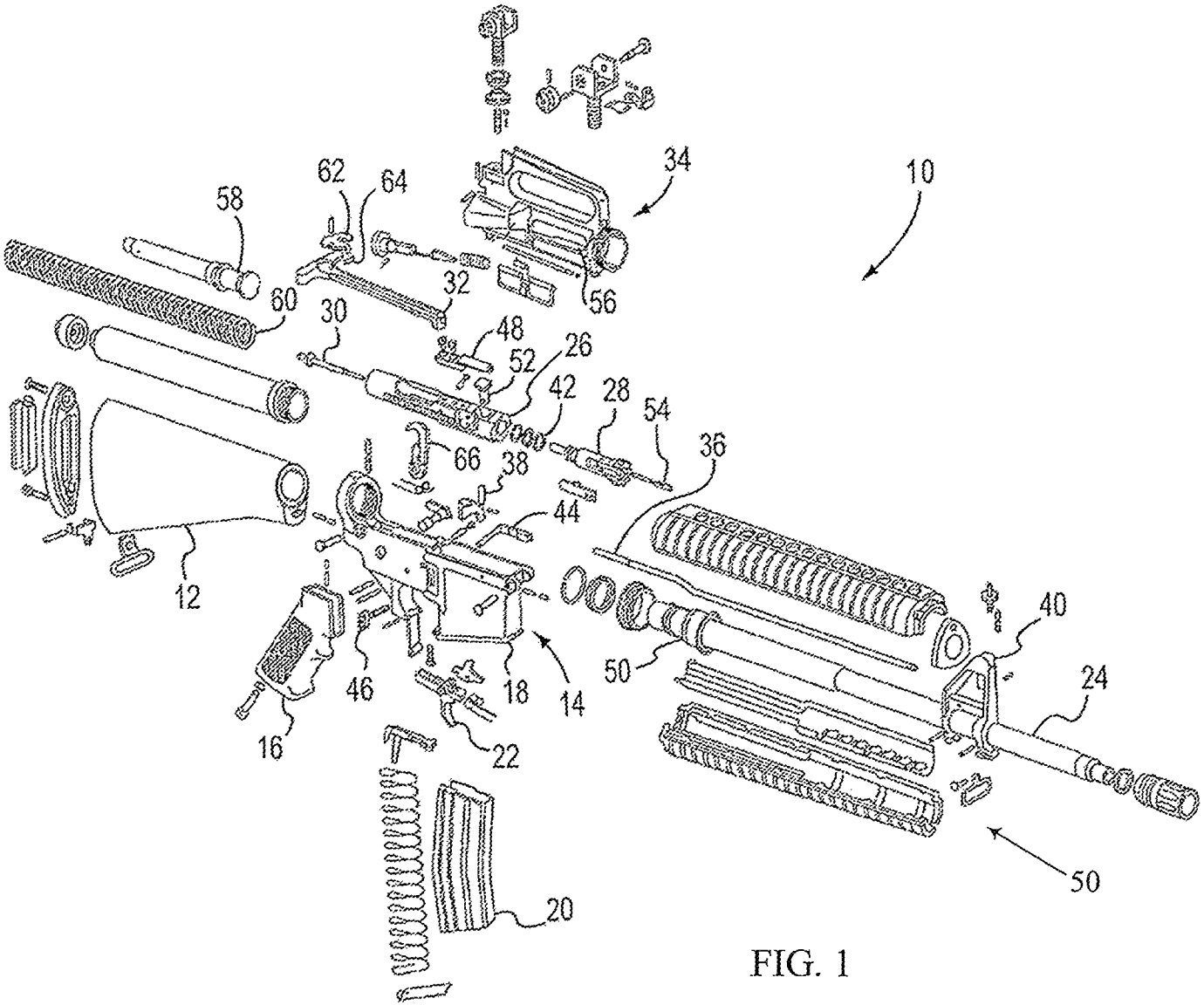
FIG. 1 shows an exploded view of an example firearm usable with aspects of the current disclosure.

Aspects of the present disclosure relate to improvements in the operational components of semiautomatic, select fire, and/or fully automatic firearms and weapons, including various center fire caliber and other weapons or firearms, whether commercial or defense oriented, and whether using direct impingement (DI) or expanding gas operation, and/or whether piston operated, as well as methods of assembly and use thereof.

Carrier/Gas Key "Interlock"

The use of an additional connection interface for a detachable gas key on the Stoner FOW forward of the gas hole on the bolt carrier is disclosed. The Inventor discovered that one reason for decreased performance of the Stoner FOW was leakage between gas passage 73 (FIG. 2) and the corresponding gas hole on bolt carrier 26 (FIG. 1) due to inconstancies and or warping of the flat mating surfaces (e.g., reference 76 in FIG. 2) of a gas key 48. The inventor further discovered that using a sealant between mating surface 76 (FIG. 2) and the corresponding mating surface (not shown) of a gas key 48 (FIG. 1), would often lead to clogging of the gas passage 73 and/or gas hole (not shown).

Figure 7:
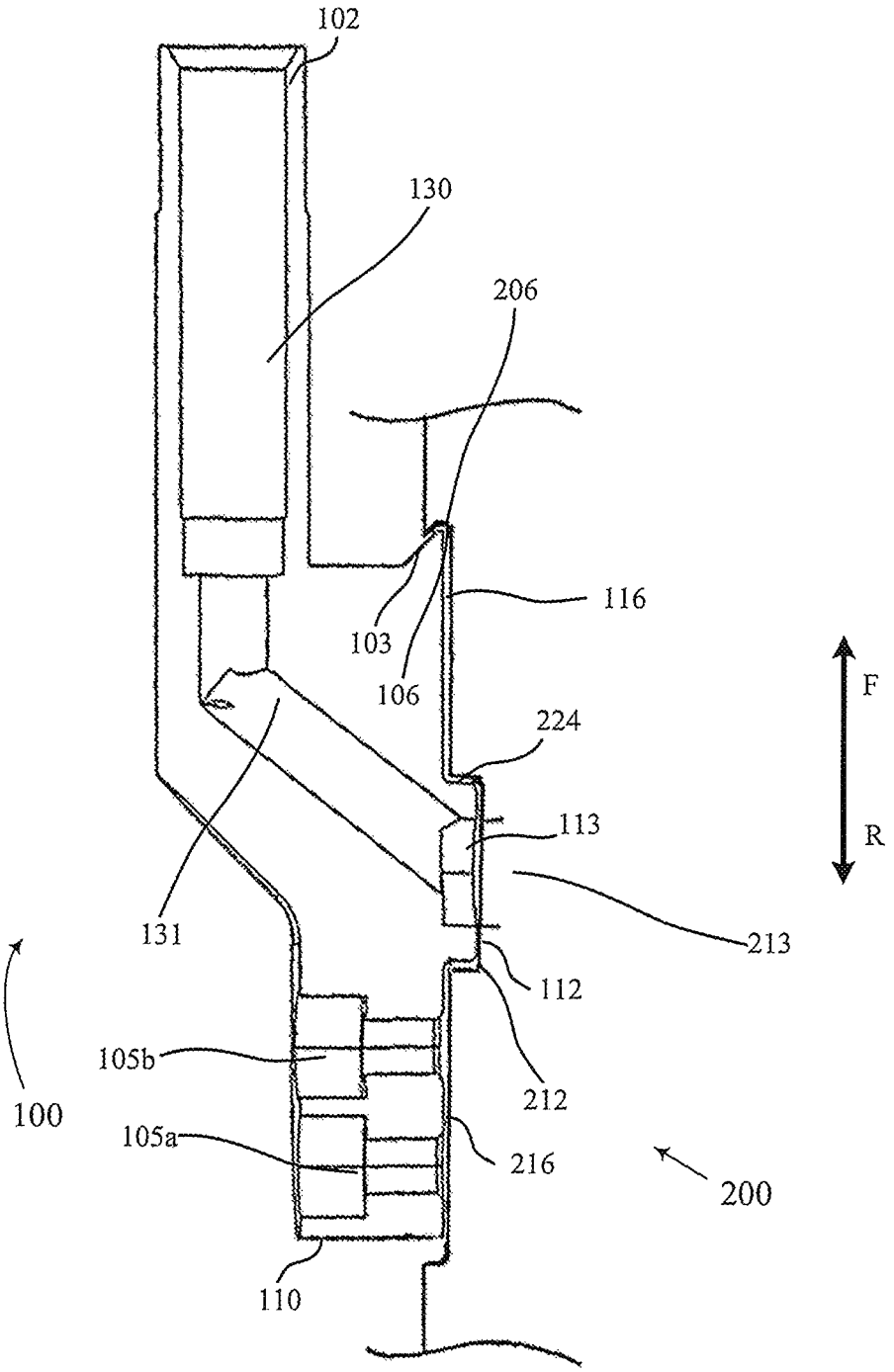
FIG. 7 is a side cross-section view of the gas key of FIGS. 3-6 mounted to a bolt carrier.
Figure 8:
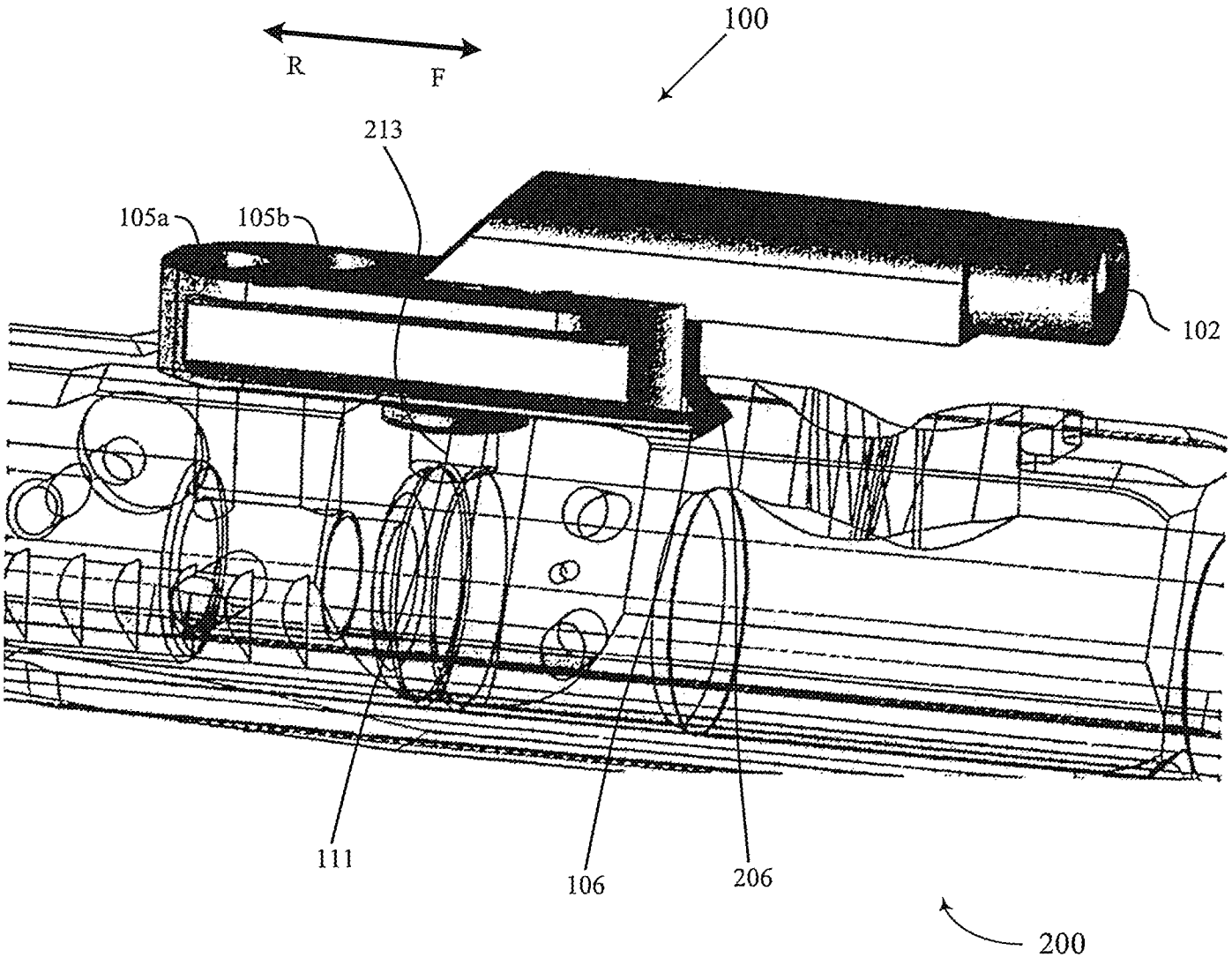
FIG. 8 is a side perspective view of the gas key of FIGS. 3-7 mounted to an example bolt carrier.

As shown and discussed with reference to FIGS. 3-8, the current disclosure provides a series of features for an improved interface between a bolt carrier and a gas key. It is noted that, while FIGS. 3-9 show a number of features/improvements, each individual feature and/or improvement may be used separately and/or in combination with each disclosed component and/or any interface known in the art without departing from the scope of the present disclosure. As shown in FIGS. 3-8 and as best shown in FIGS. 4-5, one aspect of the disclosure comprises an improved attachment interface comprising a gas key interlock portion 106 that interfaces with a corresponding bolt carrier interlock portion 206 (FIGS. 7 and 8), for example. It is noted that, while FIGS. 7 and 8 show a half-dovetail style joint, this attachment may be friction fit, or mechanical, or via weld, or via adhesive—without limitation and/or may include a tongue and groove, for example. With comparison to the flat interface 76 of the gas key 48 in FIGS. 1 and 2, the substantially flat base portion 116 of gas key 200 (FIGS. 3-8), which may hereafter interchangeably be referred to herein as an interface surface, extends further forward in direction F than corresponding related art features and may terminate at a gas key interlock portion 106 (FIG. 3) that may mesh and "lock" into the bolt carrier interlock portion 206 (FIGS. 7 and 8) of carrier body 200, for example. With the addition of the bolt carrier interlock portion 206 and gas key interlock portion 106, the gas key 100 and bolt carrier 200 may be held together with an additional interface and not just via, for example, two screws or fasteners that are received in openings 15*b* and 15*a* in FIG. 2 and through openings 105*a* and 105*b* in FIGS. 3-8. Openings 105*a* and 105*b* may be interchangeable referred to as a first and/or second fastening portion herein. The gas key 100 may be fitted more securely by relying on the inherent strength of the ordnance steel at the interface between the gas key interlock portion 106 and the bolt carrier interlock portion 206, for example, rather than being held onto the bolt carrier solely with two fasteners.

As discussed above, the gas key 100 may extend forward in direction F when compared to the technical data package ("TDP"—Technical Data Package, which is the military specification standard) per military specification for example.

Figure 2:
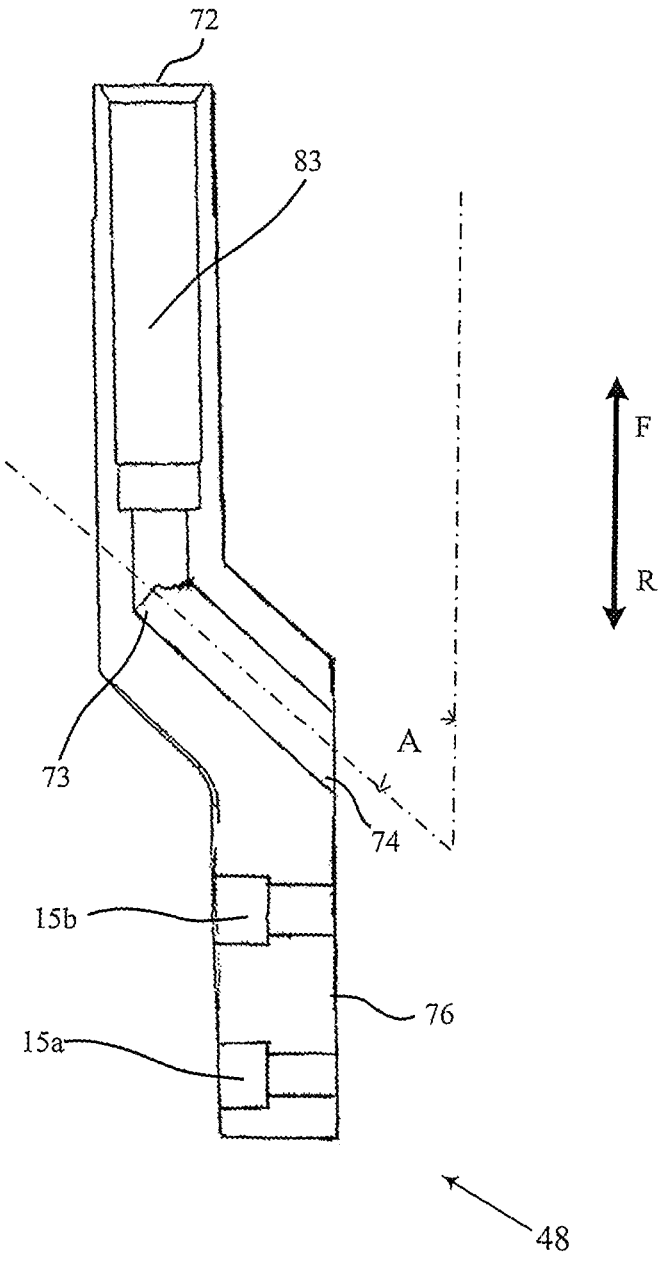
FIG. 2 Related Art
FIG. 2 is a cross-section side view of a gas key.

In one aspect, the gas key interlock portion 106 may extend the base of the gas key 100 in a forward direction (e.g., F direction shown in FIG. 3). [[ ]] In the gas key 48 shown in FIG. 2, the flat base 76 of the related art stops about 0.200-0.210" from the forward tangent of the gas hole of the bolt carrier (e.g., reference 0.213 of bolt carrier 200 in FIG. 8). In the currently disclosed gas key 200, the gas key interlock portion 106 is now more than 0.210-0.220" from the gas hole 213 at the base 116 of gas key 100. Thus, the base 116 of the gas key 100 is closer to the forward tip of the gas tube receiving opening 102 (which accommodates a gas tube) than the extant 1.20" or so distance when measured from a forward most portion of the gas key base 116 to the forward most portion of the gas tube receiving opening—thus this distance Is reduced from 1.20"." In one aspect, the gas key may include a front face 119 and the interlocking portion 106 may extend forward of the front face 119.

During operation of the example firearm shown in FIG. 1, a pulse of pressurized gas is transferred from the gas tube 36 to the gas tube receiver portion 83 (FIG. 2), and to the gas hole (not shown) of the carrier. This pulse of pressurized gas can range from about 2,000 pound-force per square inch ("psi") to approximately 10,000 psi, for example. Thus, the engagement of the gas key interlock portion 106 (FIG. 5) with the bolt carrier interlock portion 206 (FIGS. 8 and 9) may help offset any tendency of the gas key to raise or "lift" when pressurized, which, among other things, may prevent the leaking of gas from between surfaces 116 and 216 (FIG. 8) and improve performance of the firearm. Surface 216, which may be a flat surface on the bolt carrier configured to mate with the interface surface or base 116 of the gas key, for example, may also be Interchangeably referred to as a bolt carrier interface surface herein.

Figure 3:
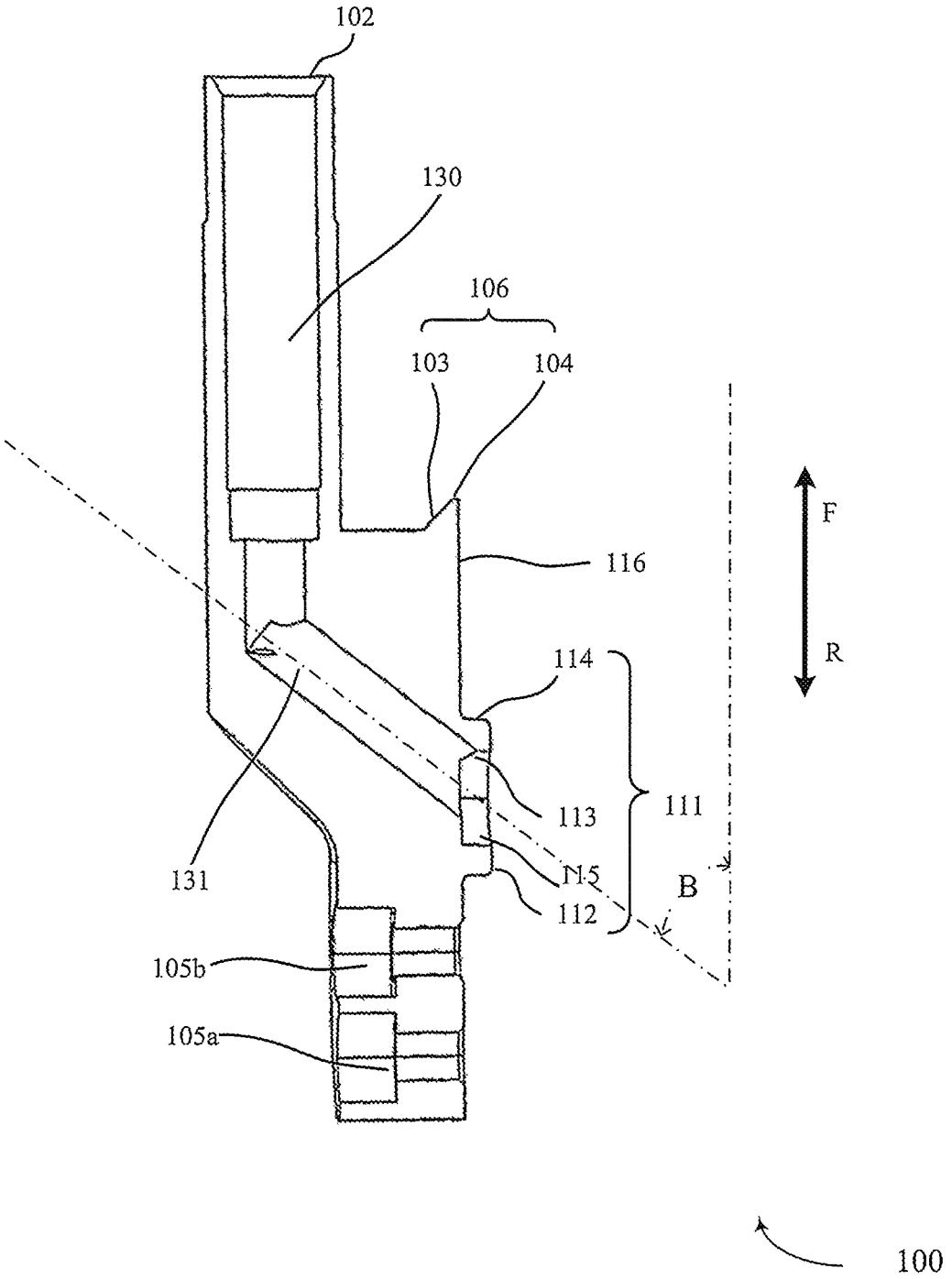
FIG. 3 is a cross-section side view of a gas key in accordance with one aspect of the disclosure.
Figure 4:
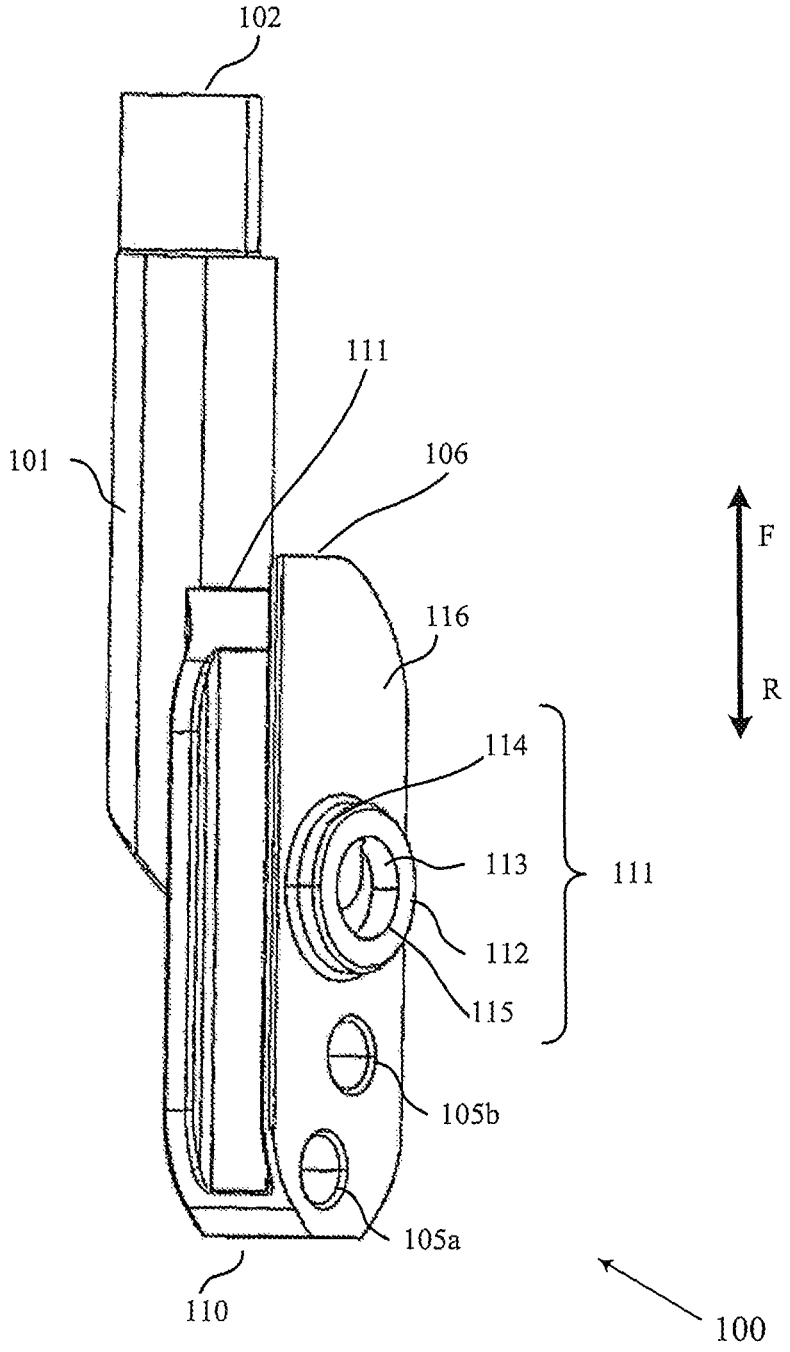
Figure 5:
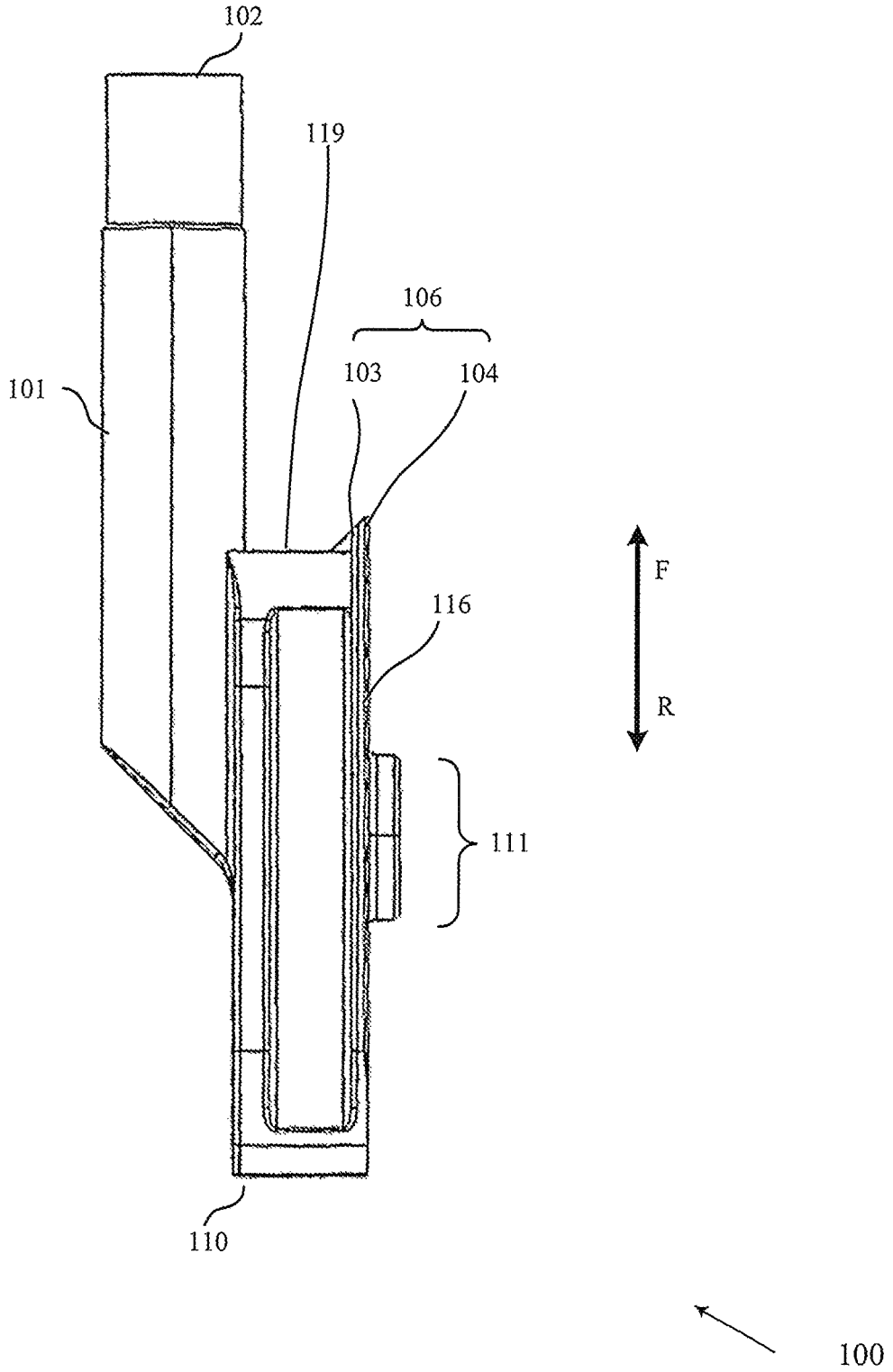
FIG. 5 is a side view of the example gas key of FIGS. 3 and 4.
Figure 6:
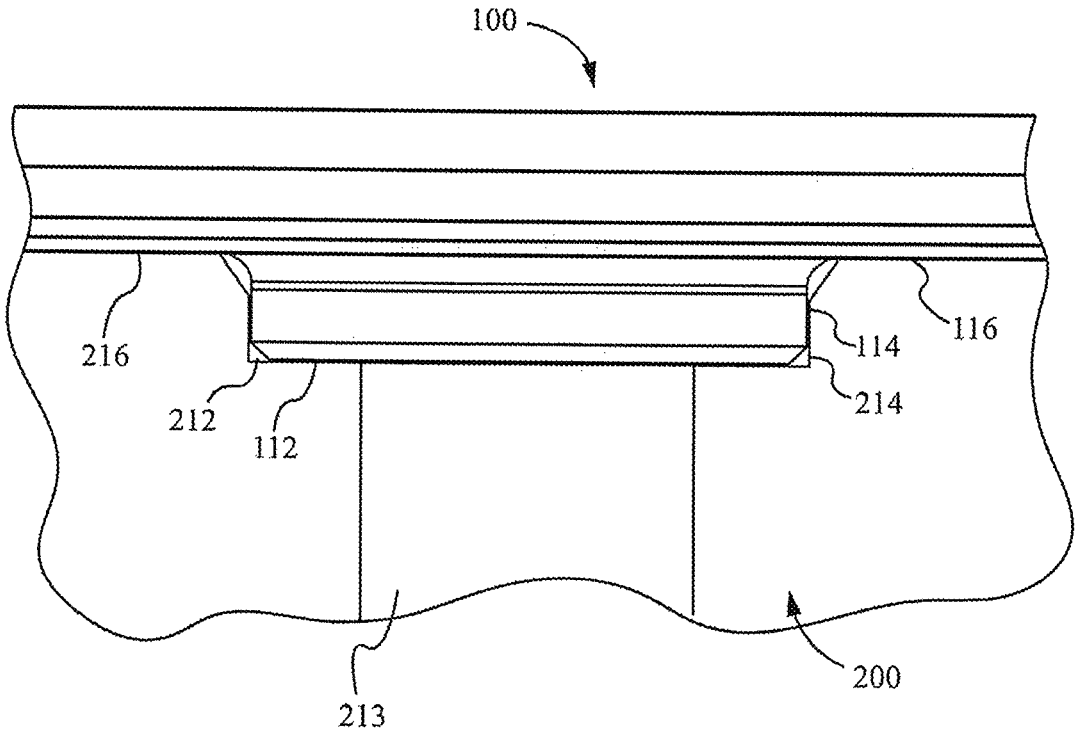
FIG. 6 is a close-up partially see-through side view of the example interface useable with the gas key of FIGS. 3-5 and a corresponding interface in a bolt carrier.

As shown in FIGS. 3, 4, and 6, the interlocking portion 111, may include a protrusion from flat surface 116 that includes on outer wall 114, an inner wall 115, and a surface 112, which may be a mating surface, for example. The interlocking portion 111 may extend generally downward from the current bottom surface 116 of the gas key 100, as shown in FIGS. 3, 4, and 6, which rests atop and is mountable to the bolt carrier 200. As shown in FIGS. 7 and 8, the bolt carrier 200 may include a concave portion configured to receive the interlocking portion 111 of the gas key. The concave portion of the bolt carrier 200 may include side wall 212, a bottom wall 112, and a gas passage or hole 213. Thus, the gas key 100 may be configured to "lock" into the bolt carrier 200 via a steel to steel fit between the concave portion of the bolt carrier 200 and the interlocking portion 111. The aforementioned construction reduces full reliance and thus addresses potentially increased stress on the fasteners (not shown) that are received in openings 105*a* and 105*b* of the gas key and threaded into the bolt carrier 200. Thus, the interface between the interlocking portion of the gas key 100 and the concave portion of the bolt carrier 200 may add strength to the connection of the gas key 100 and bolt carrier 200 and help prevent any tendency of the rearward movement of the gas key 100 when pressurized. In addition, the interface may prevent stresses from being applied to the extant screws or bolts (not shown) used to fasten the gas key 100 to the bolt carrier 200.

Furthermore, the interlocking portion 111 may extend downwardly, with respect to surface 116, as shown in FIGS. 3, 4, and 6, and may extend radially, as well, from about the gas hole 113 in the gas key 100, and may use one or more additional horizontal surfaces (in addition to the base or bottom of the Gas Key which is a horizontal surface or plane, in addition to the extant base as well as one or more vertical or otherwise angled or curved surfaces) to create a three dimensional protrusion.

Additionally, the Interlock described above may be extended outwardly from the nominal 0.400" width (0.4035" maximum) of the gas key 100 to lock into the bolt carrier 200 at the sides of the gas key 100 as well.

FIGS. 5-7 show views of the gas key 200 and a partial cross-sectional view of the carrier 200 (FIGS. 6 and 7). As shown in FIG. 5, the gas key 100 may include a gas tube receiving opening 102 and a gas tube receiver 130, for receiving a gas tube (e.g., reference 36 in FIG. 1). The gas tube receiving opening 102 and gas tube receiver 130 may be in fluid communication with a gas passage 131, which passes through interlocking portion 111 (FIG. 100) at opening 113. Further, the opening 113 may be in fluid communication with a gas receiving portion or gas hole 213 (FIGS. 7 and 8) when the gas key 100 is mounted to the receiver 200. The additional surface contact area between the interlocking portion 111 and the concave portion 190 of the carrier 200 may help to anchor the gas key 100 to the bolt carrier 200 mechanically. This feature performance this function both in a backward (e.g., direction R) and forward (e.g., direction F) manner, as well as a side to side or diagonal manner. In addition to a more secure mechanical fit, the seal—or resistance to leakage of gas between the opening 113 of the gas key 100 and the gas receiving portion or gas hole 213 of the bolt carrier 200—may be dramatically improved. It is noted that, while the interlocking portion and the concave portion are primarily described as a press-fit or metal-to-metal fit with reference to FIGS. 3-8, further improvements may be made to seal the interface. For example, an o-ring, gasket, and/or a gasket material may be provided to the interface to improve a seal therebetween.

Further, it is understood that the aforementioned interlocking portion and concave portion are not limited to as described with reference to FIGS. 3-8; for example, while the interlocking portion and concave portion are shown as circular about a cross-sectional edge, any suitable other cross-sectional shape may be used. For example, the interlocking portion and the respective concave portion may be formed as having an oval, a square, a rectangle, a triangle, a polygon and/or any enclosed multi-sided cross-sectional shape. In addition, while the gas key 100 includes the interlocking portion and the bolt carrier 200 includes the concave portion in the example described with respect to FIGS. 3-8, in one aspect the gas key may include a concave portion similar or identical to the concave portion described. Likewise, the bolt carrier 200 may include an interlocking portion similar or identical to interlocking portion 111.

As shown in the example implementation of FIG. 2, the gas passage 73 of a typical gas key 48 of the related art is angled 45 degrees with respect to flat surface 76. Thus, as shown in FIG. 2, angle A is 45 degrees. In the currently disclosed example gas key 100, as shown, for example, in FIG. 3, angle B is greater than 45 degrees and less than 50 degrees. One advantage of altering the angle of the gas path 131 to be greater than 45 degrees and less than 50 degrees is to allow for clearance with and/or to maintain wall thickness of the interlocking portion 111. Further, a gas passage angle of greater than 45 degrees prevents the gas traveling within the gas passage 131 from being diverted improperly between the gas key 100 and bolt carrier 200 at the interface between the interlocking portion 111 and the concave portion of the bolt carrier 200.

In one aspect, the aforementioned interlocking portion 111 and concave portion may be combined with the gas key interlock portion 106 that interfaces with a corresponding bolt carrier interlock portion 206 (FIGS. 7 and 8) to prevent vertical movement as well as to prevent or reduce any horizontal movement as well.

Although the above description describes a protrusion from the gas key 100 to the bolt carrier 200, the same principles can be reversed, and the bolt carrier 200 may extend in a similar ways with the gas key 100 correspondingly recessed, for example to achieve the similar goals of a more robust gas seal and more secure attachment.

The interlocking portion 111 and corresponding concave portion also serves to increase strength of the components and provide failover capability if a screw or bolt—normally used to connect the gas key 100 and bolt carrier 200—should loosen or break. The aforementioned interfaces also serve to relieve pressure or forces on the screws or bolts that are used to connect the gas key 100 to the bolt carrier 200.

As part of this implementation, for example, or separately, the Gas Nozzle (front of the Key that mates to the Gas Tube on the Rifle or Carbine, etc.) may be shortened by as much as 0.450" in length, for example. This shortening reduces the chance of damage if the Carrier is dropped outside of the gun, for example.

This nozzle 130, which may also herein be interchangeably referred to as a gas tube receiver, may also be increased in diameter to increase durability, from the current 0.248" or so to 0.249" or greater.

Carrier Enhancements

The area around the Gas Hole may be formed so as to protrude upwardly into the Gas Key, or to accommodate a similar downward protrusion from the Gas Key, such as in order to better anchor the Gas Key and seal the gasses.

Similarly, the area forward or to the sides of the Gas Key location may be machined or "notched" to accommodate a modified Gas Key, along the lines as described above.

To decrease oscillation of the Carrier within the Upper Receiver, the use of a diameter wider than 0.9945" overall diameter is repeated here. Current TDP OD is 0.9935-0.9945", which is within the 1.00" and often greater diameter of the Upper Receiver.

The decrease in width of the Carrier Underside, which comes into contact with the cartridges in the Magazine, from current 0.400-0.300" to less than 0.400-0.300" is also selected for the purpose of decreasing drag on the Bolt Carrier during firing operation. The Carrier Underside is maintained at the width used in the related art for presumed purposes of helping maintain the cartridges in position during cycling. The present Inventor has found otherwise—that the Magazine maintains proper force on the cartridges without contact from the Carrier during firing operation. Ideally Carrier contact with the cartridges during firing operation will be reduced or eliminated to promote better cycling, as otherwise there is excessive parasitic drag.

Bolt

Increasing the size of the filet or radius found at the base of the sides of the Bolt Lugs—currently a maximum of about 0.010" is disclosed. This approach serves to increase the strength and especially the fracture resistance of this area—which is a critically weak and often damaged area of the related art TDP (Technical Data Package or mil spec-military specification) pattern Bolt.

Similarly, the increasing the size of the TDP radius found around the Cam Pin hole on the Bolt to greater than extant 0.005-0.010" is disclosed, as well.

Increasing the outer diameter of the "wear ring" to greater than current TDP dimension (0.5280") to about 0.5281 to 0.5287", or preferably 0.5286-0.5292" or even more preferably 0.5290-0.5296" or more to the limits of about 0.531" are disclosed. This approach increases the stability of the Bolt cycling during firing.

Further, in the present disclosure, the "wear ring" may be made longer than standard 0.100-0.110" length (front to back), and more than one wear ring may be used. This approach also helps with stability.

Lug width may be increased to wider than 0.102" standard TDP width of the related art in order to promote strength and robustness, and lug height may be reduced from standard 0.104-0.1065" TDP height. Thus the lugs may be made wider than they are tall when measured from top to bottom and side to side. This approach helps increase robustness and durability of a part that is often subject to failure.

By increasing the size of filets of chamfers or radii at the base and top of the Lug, as well as decreasing the height of the Bolt Lug—whether through actual shortening of the part or effective reduction of the part size by raising the "base" area, the ratio of "straight wall" height (portion of the Lug side that is perpendicular to normal base or top location) that is subject to great shear forces may be reduced from the current 80.7-84% or so of the total exposed "height" to less than 80.7%, and as little as 60-65% of total height. This height is measured from base to top.

The "base" area described above may use a diameter of the Bolt in the area between the Lugs of greater than 0.530", which is the current TDP standard. This diameter may be increased to about 0.545-0.550"–0.565" or so—and even greater diameter with changes to the current M16/M4 Barrel Extension. This approach enables the material—which is critical in function, especially in the case of a high pressure ruptured cartridge—to be greater than 0.070-0.075" or so in thickness, to about 0.080-0.0875" or more in thickness. This increase in thickness creates a critical safety margin that is currently thinner than optimal in the related art, while still remaining fully functional with existing M16 and M4 pattern Barrel Extensions. Other Bolts seeking improved performance have required the use of proprietary Barrel Extensions, which limit acceptance within the market.

Another aspect of the present disclosure includes Dual Ejectors, which may be fitted by rotating the Ejectors as previously disclosed by the present inventor, and optimally this. approach changes the outer distance from the Ejectors from 0.100" or so to 0.150-0.250" distance, and optimally 0.200-0.300", and most optimally 0.300-0.400" or more. This increase in distance serves to stabilize the fired casing during Extraction, as well as provides maximum Ejection force. The distance between the Extractors, on a Bolt Face measuring about 0.385", will be about 0.075" to about 0.170" depending on selected orientation of the Ejectors.

Charging Handle

For use in accordance with aspects of the present disclosure, features relating to sand cuts in the outer surface of the charging handle (CH) are repeated here (from the Inventor's prior disclosure) for emphasis, as is the use of more than one contact point on the top (when viewed side to side) or sides (when viewed from either left or right side from top to bottom). This approach enhances stability of the CH within the Upper Receiver.

The Latch to the CH may be made taller-top to bottom—than it is wide—side to side. The latch of the related art is normally wider and short relative to the latch in accordance with this aspect of the present disclosure. The latch of the related art creates undesirable pressure on the finger and also creates wide latches that tend to catch on gear or foliage and also poke into the body when the rifle is slung (worn with a sling, against the body). Current Latches have a height (top to bottom) that Is significantly less than the width (side to side). The ratio of width to height Is usually a maximum of 0.5 to 1. Aspects of the present discourse include a latch having a width to height ratio of greater than 0.5/1, and preferably 0.75/1 or more and more preferably 1/1 and greater. This approach increases the comfort to the shooter when the weapon is carried slung, as the latch will not protrude into the torso, and also provides the finger or hand with more space or "purchase" when activating the Charging Handle.

Hammer

For use in accordance aspects of the present disclosure, features relating to extending the Hammer to more than 1.455" above the hammer pin center are repeated (from the present inventor's prior disclosure), as is the movement of a contact surface more than 0.200 to 0.230 to 0.300" or more from the front or "face" of the hammer—this surface is the portion that strikes the Firing Pin during the firing sequence. As previously disclosed by the present inventor, this approach enables greater travel of the Carrier, without the Carrier falling off of the Hammer during the firing sequence. This result may be accomplished by utilizing a surface that is formed so as to be in contact via additional angles, or via additional curvature—alone or together—In order to enable such operation.

Cam Pin

For use in accordance with aspects of the present disclosure, the reduction of the height measured from top to bottom of the area of the sides of the Cam Pin "head"—which come into contact with the Upper Receiver—are repeated here (from the inventor's prior disclosure), so as to be less than approximately 0.093". Among other things, along the lines as previously disclosed by the present Inventor, this approach reduces parasitic drag. The "head" may be made wider than the nominal 0.400" of the related art, in order to better stabilize the Bolt—this advantage identified by the present inventor in prior disclosure, is also repeated here for emphasis.

Compound Cam Path

For use in accordance with aspects of the present disclosure, the reduction of the "locked dwell", currently 0.073", to less than 0.073" even to 0.045" or less is repeated here from prior disclosure by the present inventor. So too is the reduction of the "unlocked dwell" to less than 0.042" down to total elimination of such dwell. Dwell of 0.042" per mil spec is set in the related art indicated in the TDP. The present inventor's prior disclosure of a faster turning radius than called out in the TDP Cam Path during the first 3-5 degrees of rotation is repeated here for emphasis. This approach will start the Bolt turning earlier than it is in the TDP Cam Path of the related art. After the initial 3-5 degrees of rotation (from 22.5 degrees to about 19.5 to about 17.5 degrees), the slowing of the "turn rate" from the initial 3-5 degrees is called out. Exceptions are made as indicated below for the first degree of rotation, as well as optionally the second degree. With this approach in accordance with aspects of the present disclosure, the Bolt rotates less rapidly in the final 17.5-19.5 degrees than it does in the related art TDP Cam Path. Among other things, these changes serve to optimize the unlocking of the Bolt and provide movement, albeit slower, than is carried out in the related art when the chamber pressure is high and the Bolt is under greatest stress. As the chamber pressure drops and the Bolt is less stressed—and the cartridge is less swollen or "obdurated"—in accordance with aspects of the present disclosure, the Bolt turns at a faster rate than it did in the first 3-5 degrees in the related art called out above. This approach thereby enables longer part life, smoother operation, and less exposure to the shooter of toxic and harmful gasses, among other things.

Additionally, the change in movement or rotation in the first degree (from fully locked at 22.5 degrees to start of movement by 21.5 degrees), thereby taking less than the related art approximately 0.041" of movement defined in the related art TDP movement, of the Cam Pin within the Cam Path is disclosed. Thus, the first degree of rotation may be faster, or rotate more rapidly in the first degree (22.5 to 21.5 degrees) of movement, by about 1 degree in about 0.041" of space. This rotation may now occur in 0.040-0.030", or 0.030-0.020", or even 0.020-0.010" or less of movement. This approach enables the space available to be used more efficiently, especially when used in conjunction with various features of other prior disclosures of the present inventor.

The second degree of movement (21.5 to 20.5 degrees) resulting with various features in accordance with aspects of the present may use either more than the related art TDP dimension of about 0.014" of space, or it may use less than the related 0.014" of space.

The final three degrees of movement (3 degrees to 0 degrees—fully unlocked position) may use a faster rotational rate than the related art in the TDP (0.007-0.008" movement per degree of rotation) if so selected.

Bolt Catch

Aspects of the present disclosure include use of a wider portion of the Bolt Catch within the Lower Receiver channel—for the Bolt Catch to thus be "thicker" as measured front to rear within the Receiver channel than the extant 0.150" per the related art TDP. This approach increases strength and stability of the part in operation. In one implementation, this increased thickness may range from 0.151" to as much as 0.160", given sufficient clearance in the channel—this result occurs since some commercial firearms are occasionally somewhat undersized.

Further stability increases of the Bolt Catch may be obtained in accordance with aspects of the present disclosure by reducing the Pin Hole size in the Bolt Catch from 0.104" to less than 0.104" and in some implementations preferably to as little as 0.094". This approach closes the gap between the Bolt Catch and Pin (3/32" size)—per TDP dimensions of the related art—from about 0.008-0.010" of clearance (which is excessive in the present inventor's experience), to as little as 0.001-0.002" of clearance between the Bolt Catch and the Pin. This approach permits proper operation while stabilizing the Bolt Catch more efficiently. Otherwise, the Bolt Catch may move or wobble excessively.

In order to make assembly easier, with or without tightened dimensions as described above, aspects of the present disclosure include the use of chamfers or radii, etc. about the Bolt Catch Pin hole. Such features may, for example, be important for assembly, as the part may not be visible during assembly; hence tighter tolerances may unduly interfere with assembly without the addition of such features.

To promote better operation, especially with activation of the "catch", aspects of the present disclosure Include the use of larger mass paddles, having greater mass than the related art TDP Bolt Catch weight of about 0.406 oz. Such larger mass paddles may extend, for example, greater than 1.060" from the opposite side of the Bolt Catch that moves within the Receiver. Such paddle features, among other things, help to counterbalance any extensions that are made for purposes of providing ambidextrous function (as described further below), for example, and promote enhanced functional reliability. With increased mass of arms, there have been numerous instances of failure of the Bolt Catch to operate properly—thus the increased mass and outward movement of any paddle(s) may help address this problem.

Finally, in accordance with aspects of the present disclosure, the use of preferably larger chamfers or radii on all areas of the Bolt Catch subject to movement within the Receiver channel may promote more reliable and smoother operation.

Ambidextrous Arm Improvements

Additional features are disclosed herein to improve the present inventor's previous disclosure of an ambidextrous bolt catch. The width of the paddle and arm of the Ambidextrous ("Ambi") portion may be maintained as close as possible to the location of the Bolt Catch pin hole. This approach reduces the amount of leveraged weight that the Bolt Catch (and magazine spring/follower, which activate the Bolt Catch after the last round Is fired) must overcome. By maintaining the assembly as close as possible to the pin hole location, not only is the Arm protected from impact during operation, among other benefits, the force required to activate the Arm is significantly reduced. An optimal distance from the Bolt Catch Pin hole center may be between a 0.700-0.750" minimum, which clears most Hammers, and a maximum of about 1.100", which clears a standard forged TDP Lower Receiver. In the case of use with wider aftermarket receivers, this dimension may be extended outwardly as needed. In any case, aspects of the present disclosure may be used with outermost receiver portions that extend past the outermost Arm and Control Pad (the portion that the shooter touches during normal operation to catch the Bolt or release the Bolt), along the lines as previously disclosed by the present inventor.

Lower Receiver Improvements

Aspects of the present disclosure may be used with a channel deeper (from top edge of lower by Bolt Catch) than related art TDP depth of about 0.300-0.305" and an extension that is deeper than 0.300" to ideally about 0.325" to about 0.375" to ideally about 0.375" to about 0.400" or even as much as 0.475"–0.585" or more in depth, as previously disclosed by the present inventor. Such features are measured from the top edge of the receiver that abuts the Upper Receiver around the Bolt Catch. Among other things, these features may help to protect the Arm from impact and position the Pad well for the shooter.

Barrel Extension Improvements

Aspects of the present disclosure may be used with Barrel Extension Lugs adjacent to or between the Feed Ramps that are "shorter" than the other Lugs, along the lines of the present inventor's previous disclosure. This height is measured from the outer portion of the Barrel Extension to the top edge of the Lug.

In addition, aspects of the present disclosure may be used with the reduction in length horizontally from front of the Lug (which mates against the rear most portion of the Bolt Lug when the firearm is "in battery") to the starting point of any "ramp" angle or curve in the feed ramp, along the lines of the present inventor's previous disclosure. Among other advantages, such features may permit the effective angle of the Feed Ramp to be lowered ("Less steep") which promotes better feeding of the cartridge. For example, in some implementations, both of these portions of the Lug may be reduced by 1-8%, preferably 8-12%, more preferably by 12-20%, and most preferably by 20-30% or more. The "length" horizontally may be reduced by as much as 80% or more.

Extractor

Aspects of the present disclosure may be used with more than one angle on the front of the Extractor along the lines as previously disclosed by the present inventor, as such aspects may be used with thicker material—especially in the forward third of the Extractor, which is most prone to stress and breakage. Aspects of the present disclosure may be used with larger radii and filets to reduce stress in this critical area, along the lines as previously disclosed by the present inventor—such larger radii and filets are measured in comparison to related art TDP dimensions.

This written description uses examples to disclose aspects of the disclosure, including the preferred aspects, and also to enable any person skilled in the art to practice the present disclosure, including making and using any devices or systems and performing any incorporated methods. The patentable scope hereof is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Aspects from the various aspects described, as well as other known equivalents for each such aspect, can be mixed and matched by one of ordinary skill in the art to construct additional aspects and techniques in accordance with principles of this application.

While the aspects described herein have been described in conjunction with the example aspects outlined above, various alternatives, modifications, variations, improvements, and/or substantial equivalents, whether known or that are or may be presently unforeseen, may become apparent to those having at least ordinary skill in the art. Accordingly, the example aspects, as set forth above, are intended to be illustrative, not limiting. Various changes may be made without departing from the spirit and scope of the disclosure. Therefore, the disclosure is intended to embrace all known or later-developed alternatives, modifications, variations, improvements, and/or substantial equivalents.

Reference to element in the singular is not intended to mean "one and only one" unless specifically so stated, but rather "one or more." All structural and functional equivalents to the elements of the various aspects described throughout this disclosure that are known or later come to be known to those of ordinary skill in the art are expressly incorporated herein by reference. Moreover, nothing disclosed herein is intended to be dedicated to the public.

Further, the word "example" is used herein to mean "serving as an example, instance, or illustration." Any aspect described herein as "example" is not necessarily to be construed as preferred or advantageous over other aspects. Unless specifically stated otherwise, the term "some" refers to one or more. Combinations such as "at least one of A, B, or C," "at least one of A, B, and C," and "A, B, C, or any combination thereof" include any combination of A, B, and/or C, and may include multiples of A, multiples of B, or multiples of C. Specifically, combinations such as "at least one of A, B, or C," "at least one of A, B, and C," and "A, B, C, or any combination thereof" may be A only, B only, C only, A and B, A and C, B and C, or A and B and C, where any such combinations may contain one or more member or members of A, B, or C.

I claim:

1. A gas key usable with a bolt carrier having a gas hole opening, the gas key comprising:

a first end;

a second end opposite the first end;

a first opening at a first end of the gas key, wherein the first opening is configured to receive a gas tube;

a second opening in fluid communication with the first opening via a gas passage within the gas key;

a first interface surface forming a single substantially flat plane;

a first fastening portion proximal to the second end of the gas key, wherein the first fastening portion is a through hole extending through the first interface surface and configured to receive a fastener; and and a gas key interlocking feature, wherein the first gas key interlocking feature comprises:

a first locking feature including a protrusion that is formed as a unitary structure with the gas key, wherein the protrusion surrounds the second opening and extends from the first interface surface of the gas key; and a second locking feature located forward of the first gas key interlocking feature when a firearm containing the gas key is in a firing position, wherein the second locking feature comprises a first surface that is angled with respect to the first interface surface, wherein the first interface surface is configured to mate with a second surface of the bolt carrier interlock portion when the gas key is fastened to the bolt carrier via the first fastening portion, wherein the second locking feature is configured to prevent lifting of the gas key from the bolt carrier, and the first locking feature is configured to engage with a concave bolt carrier interlocking feature when the gas key is fastened to the bolt carrier via the first fastening portion, thus providing an interface between bolt carrier and the gas key when the gas key is fastened to the bolt carrier via the first fastening portion.

2. The gas key of claim 1, wherein the second opening is part of the first locking feature.

3. The gas key of claim 1, wherein the second opening is configured to align with the gas hole opening when the gas key interlocking feature is engaged with a bolt carrier interlocking feature.

4. The gas key of claim 2, wherein the interface between the concave portion of the bolt carrier and the protrusion extending from the first interface surface forms a seal between the gas hole opening and the second opening.

5. The gas key of claim 3, wherein the protrusion includes an outer wall, and an inner wall forming a portion of the second opening.

6. A system for interfacing a bolt carrier and gas key for use with a firearm, the system comprising:

a gas key with a first end with an opening at a forward end, a second end opposite the first end at a rear end, a second opening in fluid communication with the first opening, a gas key interface surface forming a substantially flat plane, and a first gas key fastening passage at the second end of the gas key, wherein the first gas key fastening passage extends through the gas key interface surface and is configured to receive a fastener therethrough, wherein the gas key further comprises a gas key interlocking feature; and a bolt carrier with a substantially flat bolt carrier interface surface with a gas hole and a first bolt carrier fastening passage configured to align with the first gas key fastening passage when the gas key interface surface is mated with the bolt carrier interface surface, the bolt carrier further comprising a bolt carrier interlocking feature, wherein the gas key interlocking feature is formed as a unitary structure with the gas key and comprises:

a first locking feature surrounding the gas hole; and a second locking feature forward of the first locking feature and comprising a first surface that is obliquely angled with respect to the gas key interface surface, wherein the angled first surface is configured to interface with an angled bolt carrier interlock surface, and wherein the gas key is configured to be fastened to the bolt carrier via an interaction between the gas key interlocking feature and the bolt carrier interlocking feature and the second opening is configured to align with the gas hole of the bolt carrier by passing a first fastener through the first gas key fastening passage and threading the first fastener into the first bolt carrier fastening passage.

7. The system of claim 6, wherein an interaction between a concave portion of the bolt carrier a protrusion extending from the gas key interface surface forms a seal between the opening in the gas hole and the second opening.

8. The system of claim 6, wherein the first locking feature further comprises:

a protrusion extending from the gas key interface surface, the protrusion including an outer wall, and an inner wall forming a portion of the second opening, wherein the gas key interlocking feature is configured to be received by a corresponding concave portion of the bolt carrier.

9. The system of claim 8, wherein an interaction between the concave portion of the bolt carrier and the protrusion extending from the gas key interface surface forms a seal between the gas hole and the second opening.

10. A gas key usable with a bolt carrier having a gas hole opening, the gas key comprising:

gas tube receiving portion with a first opening configured to receive a gas tube;

a mounting portion for mounting the gas key to the bolt carrier, wherein the mounting portion has a first interface surface forming a substantially flat plane and a first forward end proximal to the gas tube receiving portion and a second rear end opposite the second end;

a second opening at an interface surface of the mounting portion, wherein the second opening is in fluid communication with the first opening via a gas passage within the gas key;

a first fastening portion proximal to the second end of the mounting portion; and a first gas key interlocking feature comprising a first surface that is obliquely angled with respect to the gas key interface surface, wherein the first gas key interlocking feature is formed as a unitary structure with the gas key and protrudes from the first forward end of the mounting portion and is configured to engage with a bolt carrier interlocking feature, and wherein the gas tube receiving portion and the gas key interlocking feature are the forward most features of the gas key.

11. The gas key of claim 10, wherein the mounting portion further includes an interface surface, wherein the second opening is at least a portion of a protrusion protruding from the interface surface, wherein the protrusion is capable of being received within a concave portion of the bolt carrier.

12. The gas key of claim 11, wherein the second opening is configured to align with the gas hole opening when the gas key interlocking feature is engaged with the bolt carrier interlocking feature.

13. The gas key of claim 11, wherein the protrusion further comprises:

an outer wall and an inner wall forming a portion of the second opening, wherein the gas key interlocking feature is configured to be received by a corresponding concave portion of a bolt carrier.

14. The gas key of claim 10, wherein the mounting portion further comprises:

a first fastening portion proximal to the second end of the gas key, wherein the first fastening portion is a through hole extending through the first interface surface and configured to receive a fastener; and a second fastening portion proximal to the second end of the gas key, wherein the second fastening portion is a through hole extending through the first interface surface and configured to receive a second fastener;

wherein the first interface surface forms a portion of the gas key interlocking feature.

15. The gas key of claim 1, further comprising a second fastening portion proximal to the second end of the gas key, wherein the second fastening portion is a through hole extending through the first interface surface and configured to receive a second fastener.

16. The system of claim 6, wherein the gas key further comprises:

a second gas key fastening passage at the second end of the gas key, wherein second gas key fastening passage extends through the gas key interface surface and is configured to receive a fastener therethrough;

wherein bolt carrier further comprises a second gas key fastening passage configured to align with the second gas key fastening passage when the gas key interface surface is mated with the bolt carrier interface surface, wherein the gas key is fastened to the bolt carrier by passing a second fastener through the second gas key fastening passage and threading the second fastener into the second bolt carrier fastening passage.

* * * * *